US007371355B2

(12) United States Patent
Takahashi et al.

(10) Patent No.: US 7,371,355 B2
(45) Date of Patent: May 13, 2008

(54) REAGENT VESSEL CAP AND METHOD FOR SHIELDING REAGENT FROM THE AIR

(75) Inventors: Hiroyuki Takahashi, Tokyo (JP); Eiichiro Tanaka, Tokyo (JP); Hiroyuki Nakamura, Tokyo (JP)

(73) Assignee: Fujirebio Inc., Tokyo (JP)

( * ) Notice: Subject to any disclaimer, the term of this patent is extended or adjusted under 35 U.S.C. 154(b) by 719 days.

(21) Appl. No.: 10/717,910

(22) Filed: Nov. 21, 2003

(65) Prior Publication Data

US 2004/0126278 A1 Jul. 1, 2004

(30) Foreign Application Priority Data

Nov. 27, 2002 (JP) ..... 2002-343447

(51) Int. Cl.
*B65D 51/00* (2006.01)
*B01L 3/00* (2006.01)

(52) U.S. Cl. ..... 422/916; 422/102; 220/229

(58) Field of Classification Search ..... 220/229; 215/247, 354; 422/916, 102
See application file for complete search history.

(56) References Cited

U.S. PATENT DOCUMENTS 2,378,451 A 6/1945 Vensel
3,384,275 A 5/1968 Simms
4,427,110 A * 1/1984 Shaw, Jr. ..... 206/205
4,456,141 A * 6/1984 Pamment ..... 220/254.5
5,901,885 A 5/1999 Iida
6,257,452 B1 7/2001 Allen

FOREIGN PATENT DOCUMENTS

| | | |
|---|---|---|
| EP | 0 543 638 A1 | 5/1993 |
| JP | 5-294354 | 11/1993 |
| JP | 11-194132 | 7/1999 |
| JP | P2000-137032 A | 5/2000 |
| JP | 2004-157020 | 6/2004 |
| WO | WO 95/08774 | 3/1995 |

OTHER PUBLICATIONS

Japanese Office Action for Corresponding Application 2002-343447 Issued Jul. 31, 2006.

* cited by examiner

*Primary Examiner*—Jill Warden
*Assistant Examiner*—Paul S Hyun
(74) *Attorney, Agent, or Firm*—McDermott Will & Emery LLP

(57) ABSTRACT

A reagent vessel cap includes an elastic sealing member having radial slits from the center toward the outer periphery, the sealing member being arranged on the opening of a vessel body supported by a cap body, for shielding a reagent contained in the vessel from outside air; and a pressurizing member attached to the cap body above the sealing member and retained in position by the biasing force of a built-in spring member, for opening the sealing member downward along the slits by the pressure from above and returning to position by relaxing of the pressure.

8 Claims, 3 Drawing Sheets

REAGENT VESSEL CAP AND METHOD FOR SHIELDING REAGENT FROM THE AIR

BACKGROUND OF THE INVENTION

1. Field of the Invention

The present invention relates to a cap of a vessel used to contain a liquid reagent in analytical instruments which are widely employed for chemistry, biology, and medical treatments and to a method for shielding reagents from the air. More particularly, it relates to a cap attached to the opening of the vessel for sealing it, which is opened only when the reagent is collected, thus allowing the contained reagent to be dispensed and shielding the reagent from the air to prevent the evaporation and the like of the reagent and to a method for shielding reagents by using the cap.

2. Description of the Related Art

Reagents for various analytical instruments used for chemical or biological analysis and determination are generally kept in glass or synthetic resin vessels. In order to prevent the evaporation and contamination of the liquid reagents contained in the vessels, the openings of the vessels are tightly sealed for supply, transportation, and storage. When they are used, in general, the reagent vessels are stored with the seal cap removed in insulating containers at a specified temperature which are provided to the various analytical instruments, and the reagents are automatically collected from the vessels with collecting probes attached to the analytical instruments.

Since the vessels in the insulating containers are opened in principle, the liquid reagents stored in the such vessels have many problems to be solved such as the risk of contamination, changes in concentration and composition with passage of time due to the evaporation of moisture and volatile components and the outflow of the reagents due to the tipping of the vessels in handling. Accordingly, various means have been proposed for preventing the contamination, evaporation, and deterioration of the reagents.

For example, Patent Document 1, Japanese Unexamined Patent Application Publication No. 5-294354 (claim 1, FIG. 1) proposes a "cap" which includes a top wall having an opening, a skirt without a screw which is made of a soft material, which is constructed to extend downward from the top wall, and slide on the vessel to come in tight engagement therewith, a slim arm having a sealing device for sealing the opening and moving between a sealing position and an unsealing position, and a biasing device for pushing the arm toward the sealing position.

Patent Document 2, Japanese Unexamined Patent Application Publication No. 11-194132 (claim 1), proposes a cap whose lid is capable of being turned laterally upward from a cap sealing position and having an inclined bistable hinge for opening a vessel and one or more catches capable of coming in contact with a device for pressurizing the cap.

Patent Document 3, Japanese Unexamined Patent Application Publication No. 2000-137032 (claim 1), proposes means for preventing the evaporation of a reagent by holding a liquid having a lower specific gravity than that of the reagent in a vessel, which is not mixed to the reagent, and by covering the surface of the reagent with the liquid.

Furthermore, commercially available analytical instruments use a vessel having an elastic thin sealing member serving as an inside plug at the opening, the sealing member having radial slits from the center, wherein when a reagent-collecting probe is moved downward, it is expanded downward and when the reagent-collecting probe is removed, it returns to a horizontal position by elasticity to cover the opening (Architect i2000, made of Abbott Laboratories).

However, the "cap" which has the mechanically openable and closable section as described in Patent Document 1 has a very complicated structure and so requires a device for pressurizing the "cap" which is set to the vessel when applied to various analytical instruments, thus having problems to be solved in practice such as requiring an additional function and production cost for the vessel.

As described in Patent Document 3, the means for preventing the evaporation of a liquid reagent by covering the surface with a liquid having a lower specific gravity than that of the reagent has not the mechanical structure as in the above-described "cap", offering advantages of no contact between the reagent and air and preventing evaporation. However, since the opening is always opened, the leakage of the reagent due to tipping of the vessel in handling cannot be prevented.

Furthermore, the commercial inside-plug type requires careful operation in the process of attachment of the plug after the removal of the cap so that the reagent is not contaminated and particularly has the problem of contamination of a collecting probe and also of the reagent due to contact of the reagent-collecting probe with the sealing member.

SUMMARY OF THE INVENTION

Accordingly, in view of the above-described problems, it is an object of the present invention to provide a reagent vessel cap capable of preventing a change in concentration and deterioration due to evaporation and the like without exposure of a contained liquid reagent to the open air by being attached to the opening of the vessel, allowing repeated collections without the need to be detached from the opening at the collection of necessary amount by the collecting probe of the analytical instrument, and having no possibility of contaminating the collecting probe and the reagent and to provide a method for preventing the evaporation and the like of reagents using the cap.

In order to achieve the above object, according to a first aspect of the present invention, a reagent vessel cap is provided which includes: a sealing member made of an elastic body having radial slits from the center toward the outer periphery, being arranged on the opening of a vessel and supported with a cap body, for shielding a reagent contained in the vessel from outside air; and a pressurizing member attached to the cap body above the sealing member and retained in position by the biasing force of a built-in spring member, for expanding the slits of the sealing member downwardly to open the vessel by the pressure from above and returning in position by relaxing of the pressure.

According to a second aspect of the present invention, a reagent vessel cap is provided which includes: a hollow-cylindrical cap body integrally molded of a female screw to be in engagement with a male screw formed around the outer periphery of the opening of a vessel body, a flanged engaging part projecting axially thereabove, and an engaging protrusion around the upper outer periphery; a plate-like elastic sealing member arranged in the cap body, and integrally molded of a plurality of slits extending from the center toward the outer periphery and an engaging part having an inverse L-shape in section around the periphery through a hinge; a fixing member including a hollow cylinder and an engaging part formed around the lower outer periphery of the hollow cylinder, the lower surface of the engaging part being arranged on the sealing member, and one end of a spring member is firmly fixed to the upper surface of the engaging part; and a pressurizing member integrally molded of: a substrate having a through hole; an outer cylinder provided around the outer periphery of the substrate as its inner periphery being in contact with the outer periphery of the cap body; an inner cylinder provided along the through hole as its outer periphery being in contact with the inner periphery of the fixing member, the outer cylinder and the inner cylinder being vertically downwardly arranged; and an engaging protrusion provided around the lower inner periphery of the outer cylinder, the engaging protrusion being in engagement with the engaging protrusion of the cap body, wherein the other end of the spring member is firmly fixed between the outer cylinder and the inner cylinder. The pressurizing member is always positioned above the sealing member by the spring member, wherein when the pressurizing member is pushed downward against the biasing force of the spring member, the pressurizing member is pushed downward with the cap body and the fixing member as guides, the end of the pressurizing member pushes the sealing member downward, so that the slits of the sealing member is expanded to communicate the content of the vessel with the exterior, and wherein when the pressure to the pressurizing member is relaxed, the pressurizing member returns to position, so that the sealing member returns to its initial position by its elasticity to bring the slits into close contact with each other, thereby shielding the content of the vessel from the exterior.

In the reagent vessel cap according to the invention, preferably, the sealing member is made of a elastic plate having a specified thickness, has the slits radially extending from the center toward the outer periphery, and the plate is divided into four equal parts.

In the reagent vessel cap according to the invention, preferably, the slits formed in the sealing member have a length from the center of the plate to the position with which the rim of the pressurizing member is in contact.

In the reagent vessel cap according to the invention, preferably, the cap body is constructed such that the rim of the flanged engaging part around the inner periphery extends downward to be brought into contact with the inner periphery of the opening of the vessel body so as to be retained to the vessel body by the extending part and the female screw.

In the reagent vessel cap according to the invention, preferably, the fixing member has the hollow cylinder, the flanged engaging part around the lower periphery of the hollow cylinder, and the spring member whose one end is firmly fixed to the upper surface of the flanged engaging part, which are integrally molded of plastic.

In the reagent vessel cap according to the invention, preferably, the pressurizing member has a thin part at part of the upper periphery and a mark for indicating the thin part, wherein by pushing the thin part, the engagement between the cap body and the outer cylinder is cancelled.

According to a third aspect of the invention, a method for shielding a reagent from outside air is provided which includes the steps of: arranging a sealing member made of an elastic plate with radial slits from the center toward the outer periphery in the opening of a vessel body containing a reagent; arranging a pressurizing member above the sealing member, which is retained in position by the biasing force of a built-in spring member; pushing the pressurizing member from above to expand the slits of the sealing member downwardly, thereby opening the vessel to collect the reagent; relaxing the pressure to return the pressurizing member to position and also to return the expanded sealing member to its initial position by the elastic property of itself, thereby bringing the slits into tight contact with each other to shield the reagent from outside air after the collection of the reagent.

DESCRIPTION OF THE PREFERRED EMBODIMENT

Figure 1:
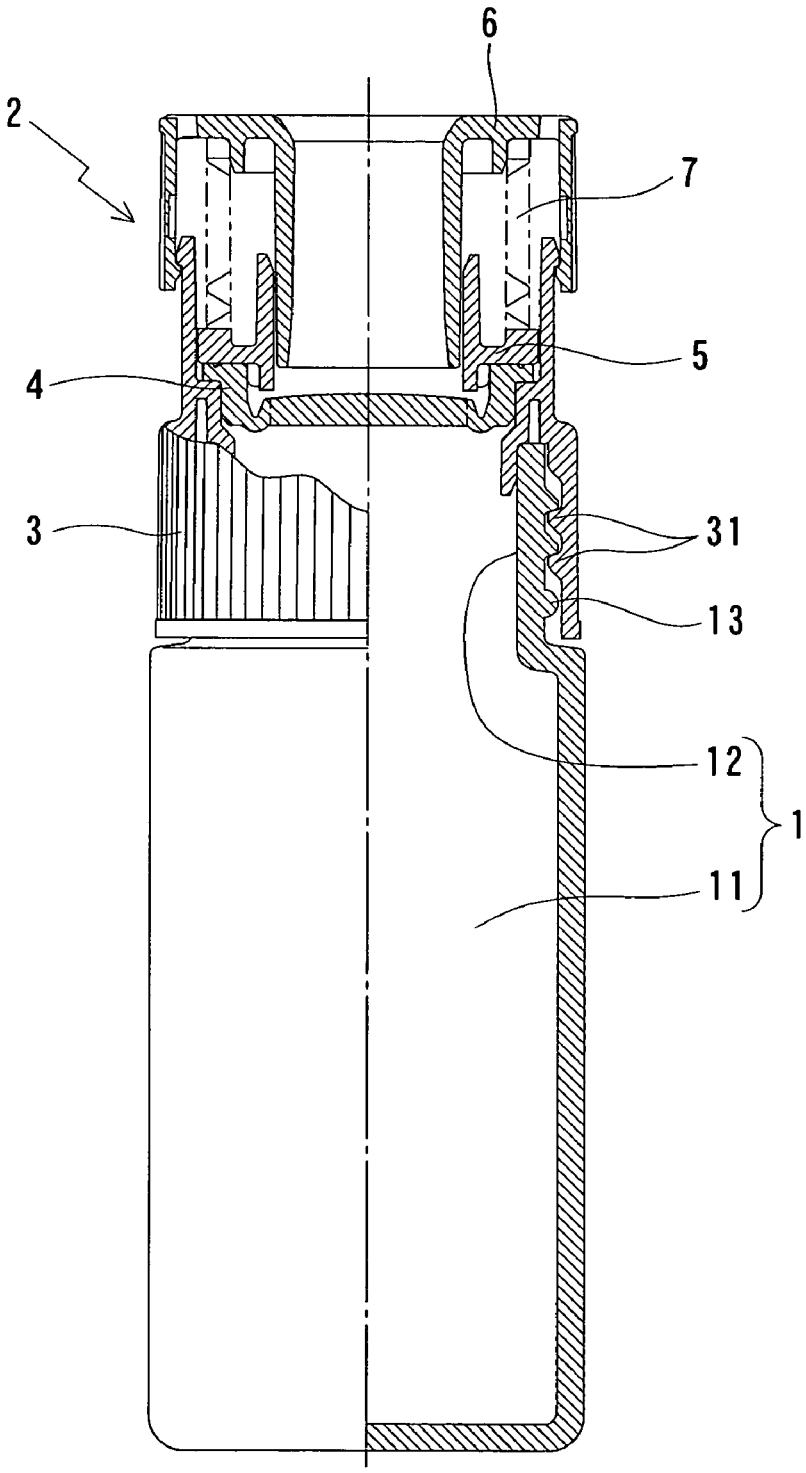
FIG. 1 is a partially cutaway sectional view of an example of how to use a reagent vessel cap according to an embodiment of the present invention.

A preferred embodiment of a reagent vessel cap and a method for shielding the reagent from outside air to prevent the evaporation and the like of reagents according to the present invention will be described hereinafter with reference to the drawings. It is to be understood that various modifications may be made in the invention without departing from the spirit and scope thereof that an openable and closable member is moved downward against the biasing force of a spring member from above of an elastic sealing member which has radial slits from the center toward the outer periphery, so that the sealing member is deformed to open the vessel body, and by relaxing the pressure, the sealing member is returned to its initial position by the elasticity of itself, thereby closing the vessel.

In the drawings, numeral 1 denotes a reagent vessel for containing a liquid reagent. A reagent vessel cap 2 (hereinafter, simply referred to as a cap 2) of the invention is attached to an opening of the reagent vessel 1 after a seal cap (not shown) attached to the opening for preventing contamination and evaporation of the contained reagent has been removed when the reagent vessel 1 is hung or stored in an insulating container of an analytical instrument or the like for use in analysis.

The cap 2 is provided as an attachment of the reagent vessel 1 or an analytical instrument. The cap 2 can be attached to individual reagent vessel at the use of the reagent, or alternatively, it can be attached to an analytical instrument in advance and the reagent vessel 1 can be in turn attached to the cap 2.

The cap 2 includes a cap body 3 attached to the outer periphery of an opening 12 of the reagent vessel 1, a sealing member 4 attached in the cap body 3 above the opening 12 of the reagent vessel 1, a fixing member 5 for fixing the sealing member 4 in a specified position in the cap body 3, a pressurizing member 6 for opening and closing the sealing member 4, and a spring member 7 interposed between the fixing member 5 and the pressurizing member 6 for holding the pressurizing member 6 in position all the time.

The reagent vessel 1 includes a vessel body 11 for containing a liquid reagent and the opening 12 which connects with the vessel body 11. The opening 12 has a male screw 13 integrated with the outer periphery thereof, with no limitation to its material.

The cap body 3 that constitutes the cap 2 is shaped like a hollow cylinder and has a female screw 31, at the lower part of the inside periphery, which is in engagement with a male screw 13 formed at the opening 12 of the vessel body 11, the whole upper part decreasing in diameter through a step 32, a flanged engaging part 33 projecting axially around the inside periphery near the female screw 31, and an engaging protrusion 34 around the outer periphery of the end thereof. The cap body 3 is molded in one piece of plastic.

When the cap body 3 is molded, by extending the end of the engaging part 33 downward to form a ring-shaped extending part 35 which is in contact with the inside periphery of the opening 12 of the vessel body 11, the cap body 3 can be more securely fitted in the opening 12 of the vessel body 11.

Figure 3:
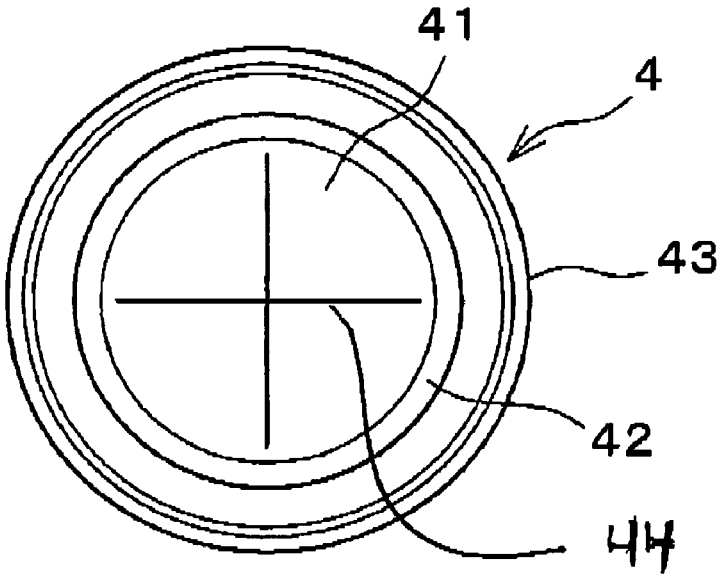
FIG. 3 is a top plain view of the sealing member.

The sealing member 4 is molded in one piece of an elastic body such as rubber such that an inverse-L-shaped engaging part 43 is formed around the outer periphery of a disk plate 41 through a thin hinge 42, the disk plate 41 having a plurality of radial slits 44 from the center toward the outer periphery as shown in FIG. 3.

The disk plate 41 that constitutes the scaling member 4 has the slits 44 extending radially and evenly from the center toward the outer periphery. The disk plate 41 and the slits 44 have the important function of sealing and opening the opening 12 of the vessel body 11. Preferably, the number of the slits is small and the thickness of the disk plate is large for scaling purpose, whereas the number of slits is large and the thickness is small for opening purpose.

In the invention, it is preferable to provide three to live slits, more preferably, to provide four slits 44 so as to divide the disk plate 41 into four equal parts in cross shape, seen from the top, with a length from the center to the position with which the end of an inner cylinder 64 (described later) of the pressurizing member 6 is in contact as shown in FIG. 3. The disk plate 41 has preferably a thickness within the range of 1 to 2 mm. However, they are not limited to those.

The fixing member 5 has a flanged engaging part 52 around the outer periphery in the vicinity of the lower end of a hollow cylinder 51 which has substantially an equal outside diameter to that of the disk plate 41, as the engaging part 52 is in contact with the upper inner periphery of the cap body 3. The back of the engaging part 52 is brought into contact with the upper surface of the engaging part 43 of the sealing member 4 to thereby retain a spring member 7.

Figure 2:
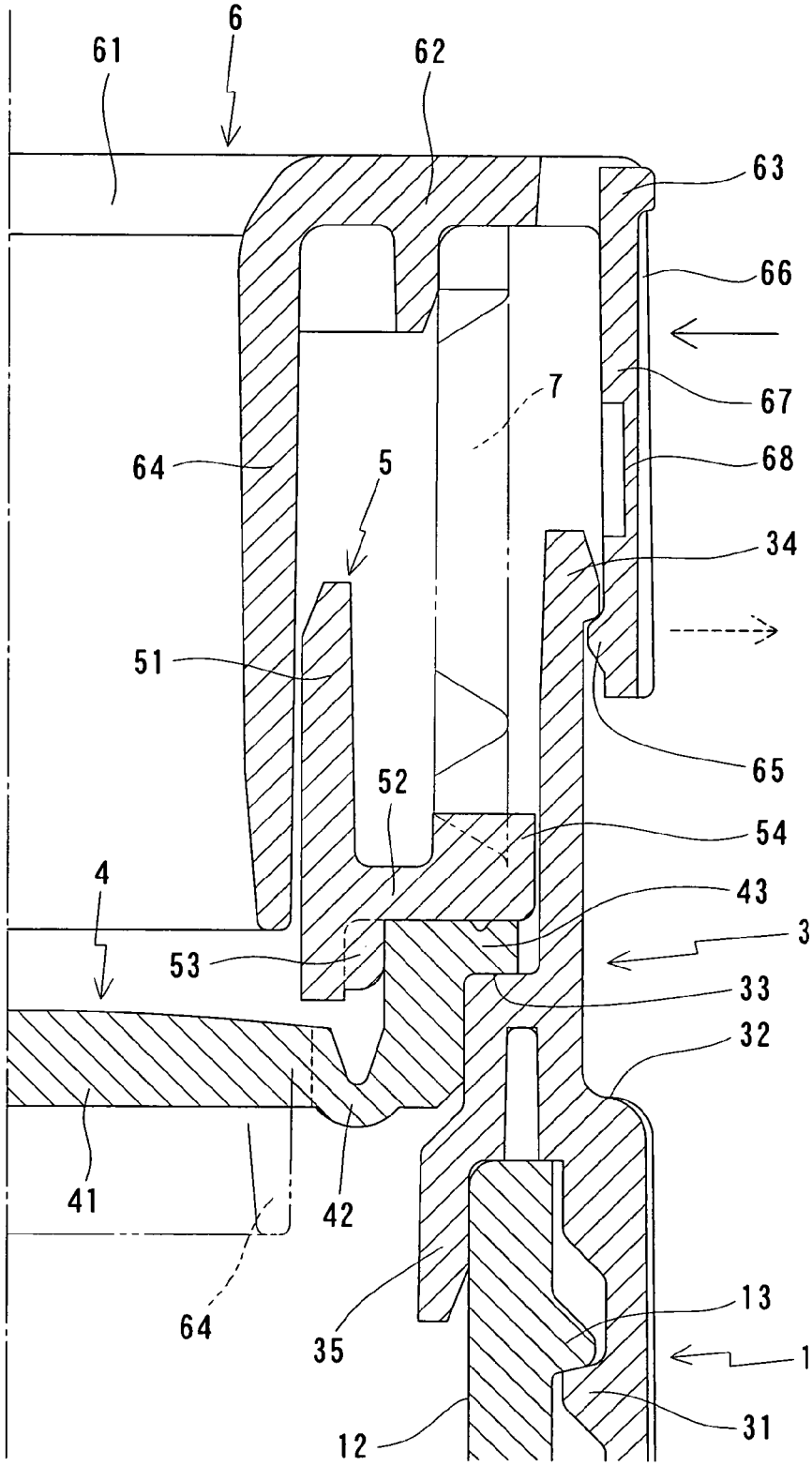
FIG. 2 is an enlarged view of part of the reagent vessel cap.

As shown in FIG. 2, by providing a protrusion 53 entirely or partly around the outer periphery of the hollow cylinder 51 under the engaging part 52 so that no space is formed between the outer periphery of the hollow cylinder 51 and the inner periphery of the engaging part 43 of the sealing member 4, the sealing member 4 is retained in the cap body 3.

On the upper surface of the engaging part 52 of the fixing member 5, a retaining part 54 is provided for retaining one end of the spring member 7; thus, the spring member 7 is retained.

While the spring member 7 may be made of metal, it is preferably formed in one piece of plastic, the same as that of the fixing member 5, in view of recycling and disposal.

The pressurizing member 6 is constructed such that a through hole 61 with a specified diameter for a reagent-collecting probe (not shown) to pass through is provided in the center, a specified-length outer cylinder 63 whose inner periphery is in contact with the upper outer periphery of the cap body 3 is provided around the back rim of a disk-shaped substrate 62 whose outer diameter is substantially equal to that of the cap body 3, and the inner cylinder 64 whose inner periphery is in contact with the inner periphery of the hollow cylinder 51 of the fixing member 5 is provided downward along the inner rim of the through hole 61, which are integrated to one piece, and the other end of the spring member 7 is firmly fixed to the back of the substrate 62 by appropriate means.

Around the lower inner periphery of the outer cylinder 63 of the pressurizing member 6, a ring-shaped protrusion 65 which is brought into engagement with the engaging protrusion 34 formed around the outer periphery of the end of the cap body 3, for retaining the pressurizing member 6 to prevent the pressurizing member 6 from coming out of engagement with the cap body 3.

In order to facilitate detachment of the pressurizing member 6 from the cap body 3, two slits 66 (only one is shown in FIG. 2) with a specified width are provided at the upper and lower ends, respectively, in symmetric positions of the outer periphery of the cap body 3. The wall thickness of the outer periphery surrounded by the respective slits 66 is reduced to form thin parts 67, and part of the inner periphery of the thin parts 67 is reduced to form a bending part 68. When the symmetric thin parts 67 are pushed in the direction of the arrow indicated by the solid line in FIG. 2, the lower end of the outer cylinder 63 expands outward with the bending part 68 as the center (in the direction of arrow indicated by the dotted line) to thereby bring the engaging protrusion 34 of the cap body 3 out of engagement with the protrusion 65 of the outer cylinder 63.

The cap 2 formed of such parts is constructed such that the inner periphery of the outer cylinder 63 and the upper outer periphery of the cap body 3 are brought into contact with each other by fitting the engaging part 43 of the sealing member 4 on the engaging part 33 formed around the inner periphery of the cap body 3, bringing the engaging part 52 of the fixing member 5 into contact with the engaging part 43, then inserting the inner cylinder 64 of the pressurizing member 6 along the inner periphery of the hollow cylinder 51 of the fixing member 5, fitting the outer cylinder 63 on the upper part of the cap body 3 while pushing the thin parts 67 formed around the outer periphery, and relaxing the pressure when they have passed through the engaging protrusion 34 of the cap body 3.

Thus, even when the pressurizing member 6 is pushed up by the biasing force of the spring member 7, the engaging protrusion 34 is surely brought into engagement with the protrusion 65 of the outer cylinder 63. Therefore, the pressurizing member 6 is not detached from the cap body 3 and the end of the inner cylinder 64 of the pressurizing member 6 is retained in position above the sealing member 4.

The cap 2 with such a structure is attached to the male screw 13 of the opening 12 of the reagent vessel 1 which contains a liquid reagent in the vessel body 11 by bringing the female screw 31 of the cap body 3 into engagement therewith. Since there is no limit to the structure, it is not limited the above example.

With the reagent vessel cap 2 of the invention, when the pressurizing member 6 is pushed downward by an appropriate means at the collection of the liquid reagent contained in the vessel body 11, the outer cylinder 63 and the inner cylinder 64 are moved downward against the biasing force of the spring member 7 with the cap body 3 and the hollow cylinder 51 of the fixing member 5 as guides, respectively, so that the end of the inner cylinder 64 comes in contact with the top face of the disk plate 41 of the sealing member 4.

Figure 4:
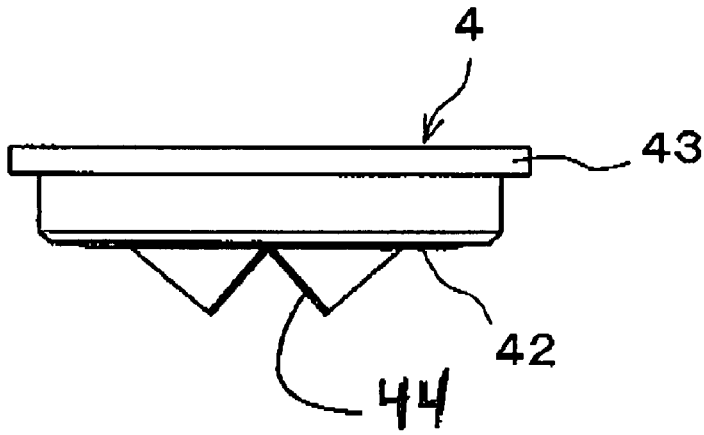
FIG. 4 is an elevational view of the sealing member when the radial slits are expanding.

When the pressurizing member 6 is further pushed downward, the sealing member 4 is expanded downward into, for example, four pans by the action of the slits of the disk plate 41 to open the reagent vessel 1. FIG. 4 shows a side elavational view of the slits 44 of the sealing member 4 expanding downward to be opened. The collecting probe is then hung down via the through hole 61 into the vessel body 11 to collect a necessary amount of reagent.

After the collection of the necessary amount of reagent with the collecting probe has been completed and when the pressure to the pressurizing member 6 is then released at the same time as or after pulling-out of the collecting probe, the outer cylinder 63 and the inner cylinder 64 are pushed up by the biasing force of the spring member 7 to return to the initial position, and so the pressure to the sealing member 4 which has been expanded by the inner cylinder 64 is also relaxed. Thus the sealing member 4 returns to the initial disk plate by the elastic force of itself to tightly seal the opening 12 of the reagent vessel 1 with the tight contact slits.

The reagent vessel 1 with the cap 2 of the invention may be applied to an analytical instrument, in which a reagent can be automatically collected from the reagent vessel 1 by vertically moving the pressurizing member 6 with the vertical movement of the collecting prove of the analytical instrument at the time of collection of the reagent.

Although the reagent vessel 1 may be made of either plastic or glass, the cap 2 of the invention is preferably integrally molded of the plastic, such as polypropylene, except the sealing member made of an elastic body such as natural rubber, synthetic rubber, and thermoplastic elastomer, in view of recycling and disposal.

The reagent vessel cap of the invention includes an elastic sealing member having radial slits from the center toward the outer periphery supported by a cap body above the opening of a vessel body which contains a liquid reagent to tightly seal the opening at all times. The cap also includes a pressurizing member retained in position by the biasing force of a spring member formed above the sealing member. By pushing the pressurizing member from above, the slits of the sealing member are expanded downward to be opened and by relaxing the pressure, it returns to position. Thus, the liquid reagent can be collected with a collecting probe without removing the sealing member from the cap for closing the vessel body. After the collection, only by relaxing the pressure to the pressurizing member, the pressurizing member returns to its initial position and also the sealing member returns to its initial position by its elasticity to tightly seal the vessel. Therefore, the liquid reagent contained in the vessel is hardly exposed to outside air; thus, alteration in reagent concentration and deterioration of the reagent due to evaporation can be prevented almost to perfection.

Particularly, according to the invention, since the elastic sealing member is opened using a cylinder having an inner diameter for the reagent probe to pass through with a margin, a sufficient path for the downward-moving reagent-collecting probe is ensured, thereby preventing the reagent-collecting probe from coming in direct contact with the circumference of the cap and the sealing member to contaminate it.

Since the pressurizing member for opening the sealing member is constructed to move vertically against or by the biasing force of the spring member, the movement is smooth and stable, thus offering the above-described advantages more reliably.

Furthermore, the reagent vessel cap of the invention has a very simple structure and a simple mechanism for opening and closing the reagent vessel which is operated by the vertical movement same as that of the collecting probe of the analytical instrument. Therefore, the application of the cap to the analytical instrument provides a simplified analytical instrument without posing the problem of exposing the contained reagent to outside air and of causing contamination and alteration in reagent concentration and reagent deterioration due to evaporation.

By the method for shielding a reagent from outside air for evaporation and the like according to the invention, an elastic sealing member having slits for closing a reagent vessel from the exterior is opened and closed by a pressurizing member having a spring member. Accordingly there is no possibility of exposing the contained reagent to outside air and causing contamination and alteration in reagent concentration and reagent deterioration due to evaporation, thus facilitating collection of the reagent.

What is claimed is:

1. A reagent vessel cap, comprising:

a sealing member made of an elastic body having radial slits from the center toward an outer periphery, is arranged on an opening of a vessel, and in a cap body, for shielding a reagent contained in the vessel from outside air; and a pressurizing member attached to the cap above the sealing member comprising a through hole and retained in position by the biasing force of a spring member firmly fixed between the pressurizing member and a fixing member arranged on the sealing member, for expanding the radial slits of the sealing member downwardly to open the vessel by a pressure from above and returning to position by relaxing of the pressure.

2. A reagent vessel cap, comprising:

a hollow-cylindrical cap body integrally molded of a female screw to be in engagement with a male screw formed around an outer periphery of an opening of a vessel body, a flanged engaging part projecting axially thereabove, and an engaging protrusion around an upper region of the outer periphery of the flanged engaging part;

a plate-like elastic sealing member integrally molded and arranged in the cap body, comprising a plurality of slits extending from the center toward an outer periphery of the sealing member and an engaging part having an inverse L-shape in section around the outer periphery of the sealing member through a hinge;

a fixing member including a hollow cylinder and an engaging part formed around a lower region of an outer periphery of the hollow cylinder, wherein a lower surface of the engaging part being arranged on the sealing member, and one end of a spring member is firmly fixed to an upper surface of the engaging part; and a pressurizing member integrally molded of:

a substrate having a through hole, an outer cylinder provided around an outer periphery of the substrate as its inner periphery is in contact with the outer periphery of the cap body, an inner cylinder provided along the through hole as its outer periphery is in contact with an inner periphery of the fixing member, the outer cylinder and the inner cylinder being vertically downwardly arranged, and an engaging protrusion provided around the lower region of the inner periphery of the outer cylinder, the engaging protrusion of the outer cylinder being in engagement with the engaging protrusion of the cap body, wherein the other end of the spring member is firmly fixed between the outer cylinder and the inner cylinder of the pressurizing member, wherein the pressurizing member is positioned above the sealing member by the spring member, when the pressurizing member is pushed downward against a biasing force of the spring member, the pressurizing member is pushed downward with the cap body and the fixing member as guides, the end of the pressurizing member pushes the sealing member downward, so that the plurality of slits of the sealing member expand and open to communicate the content of the vessel with the exterior, and when the pressure to the pressurizing member is relaxed, the plurality of slits contract and the pressurizing member returns to position, so that the sealing member returns to its initial position by its elasticity, thereby shielding the content of the vessel from the exterior.

3. A reagent vessel cap according to claim 1 or 2, wherein the sealing member having a thickness, and made of an elastic plate having a reasonable thickness to expand the slits and return its initial position by an elastic property of itself, is divided into four equal parts by the slits radially extending from the center toward the outer periphery.

4. A reagent vessel cap according to claim 1 or 2, wherein the outer periphery of the pressurizing member further comprises a top surface, and the slits formed in the sealing member have a length extending from the center of the sealing member to the top surface of the pressurizing member.

5. A reagent vessel cap according to claim 2, wherein the cap body is constructed such that the flanged engaging part of the fixing member extends downward around the inner periphery of the opening of the vessel body forming an extending part, and to be brought into contact with the inner periphery of the opening of the vessel body to be retained to the vessel body by the extending part and the female screw.

6. A reagent vessel cap according to claim 2, wherein the fixing member comprises the hollow cylinder, the flanged engaging part around the lower periphery of the hollow cylinder, and the spring member whose one end is firmly fixed to the upper surface of the flanged engaging part of the fixing member are integrally molded of plastic.

7. A reagent vessel cap according to claim 2, wherein the pressurizing member has a thin part projecting from a top surface thereof and a mark for indicating the thin part, and by pushing the thin part, the engagement between the cap body and the outer cylinder is cancelled.

8. A method for shielding a reagent from outside air, comprising:

arranging a sealing member having a fixing member, and made of an elastic plate with radial slits from the center toward an outer periphery in an opening of a vessel body containing a reagent to a first position;

arranging a pressurizing member having a through hole above the sealing member in the first position by a biasing force of at least one spring member firmly fixed between the pressurizing member and the fixing member of the sealing member;

pushing the pressurizing member from above to expand the radial slits of the sealing member downwardly to a second position, thereby opening the vessel body to collect the reagent; and relaxing the pressure from the second position to return the expanded radial slits of the sealing member to the first position by an elastic property of the sealing member, thereby contracting and bringing the radial slits into contact with each other to shield the reagent from outside air after the collection of the reagent.

* * * * *